US010258176B1

(12) United States Patent
Lowe et al.

(10) Patent No.: US 10,258,176 B1
(45) Date of Patent: Apr. 16, 2019

(54) RECTANGULAR PORTABLE TENT

(71) Applicants: Wade Lowe, Dallas, TX (US); Paul Merrill, Dallas, TX (US)

(72) Inventors: Wade Lowe, Dallas, TX (US); Paul Merrill, Dallas, TX (US)

( * ) Notice: Subject to any disclaimer, the term of this patent is extended or adjusted under 35 U.S.C. 154(b) by 0 days.

(21) Appl. No.: 16/154,601

(22) Filed: Oct. 8, 2018

(51) Int. Cl.

| | |
|---|---|
| ***A47G 9/08*** | (2006.01) |
| ***E04H 15/02*** | (2006.01) |
| ***E04H 15/48*** | (2006.01) |
| ***E04H 15/32*** | (2006.01) |

(52) U.S. Cl.
CPC ..... *A47G 9/086* (2013.01); *E04H 15/02* (2013.01); *E04H 15/324* (2013.01); *E04H 15/48* (2013.01)

(58) Field of Classification Search
CPC . A47G 9/086; A47G 2009/003; E04H 15/324
USPC ..... 5/413 R
See application file for complete search history.

(56) References Cited

U.S. PATENT DOCUMENTS 983,223 A * 1/1911 Fitch ..... A47G 9/086 128/873
1,064,630 A * 6/1913 Fiala ..... A47G 9/08 5/413 R
1,315,294 A * 9/1919 Fink et al. ..... A47G 9/08 5/413 R
2,259,267 A * 10/1941 Ranken ..... A47G 9/086 135/114
2,284,900 A * 6/1942 Henderson ..... A45F 3/22 5/122
3,083,378 A * 4/1963 Pursell ..... A47C 21/022 5/413 R
3,341,869 A * 9/1967 Whitman ..... A47C 27/22 5/413 R
3,476,127 A * 11/1969 Holt ..... E04H 15/324 135/125
4,079,472 A * 3/1978 Maguire ..... A47G 9/08 5/413 R
4,197,601 A * 4/1980 Maguire ..... A47G 9/02 2/69.5
4,605,029 A * 8/1986 Russell ..... E04H 15/324 135/125
4,698,862 A * 10/1987 Mairs ..... A47D 5/006 5/413 R
4,719,935 A * 1/1988 Gustafson ..... E04H 15/10 135/124
4,757,832 A * 7/1988 Russell ..... A45F 4/02 135/128

(Continued)

*Primary Examiner* — Noah Chandler Hawk
(74) *Attorney, Agent, or Firm* — Christopher Pilling

(57) ABSTRACT

The current invention is directed towards a rectangular portable tent providing the user easy, assisted and custom storage of gear and personal shelter from unwanted environmental elements. The rectangular portable tent is easily folded, packed or rolled for storage during transportation by the user. The rectangular portable tent may furthermore be adjoined to or a member of another piece of portable gear, such as a backpack. Additionally, the internal volume size of the rectangular portable tent is expandable or reducible by the connection of multiple rectangular portable tents to each other. Adjustment, removal or addition of multiple dividers, openings and accessory components give the user the most optimal tent they desire for specific needs and conditions.

20 Claims, 4 Drawing Sheets

(56) References Cited

U.S. PATENT DOCUMENTS

| | | | | |
|---|---|---|---|---|
| 5,458,146 | A * | 10/1995 | Gregg | E04H 15/001 135/117 |
| 6,792,631 | B1 * | 9/2004 | Hayden | A47G 9/02 5/413 R |
| 7,127,753 | B1 | 10/2006 | Ramaley | |
| 7,263,731 | B1 * | 9/2007 | Stepanek | A47C 17/64 135/116 |
| 9,669,184 | B2 * | 6/2017 | Hill | A61M 21/0094 |

* cited by examiner

RECTANGULAR PORTABLE TENT

CROSS-REFERENCE TO RELATED APPLICATIONS

N/A

BACKGROUND OF THE INVENTION

1. Field of the Invention

The invention relates generally to recreational equipment but more particularly to a rectangular portable tent.

2. Description of Related Art

Equipment aiding outdoor enthusiasts in recreational and emergency situations such as tents, sleeping bags, tarps, and pads have been used for years. Size, weight, durability, and many other factors can make a large difference on behalf of the user, as usually this equipment is portable and transported or carried by the user over a long distance. Traditionally, current tents are one of the heaviest items carried by outdoor enthusiasts. Additionally, current tents are usually cumbersome and complicated to assemble. The complexity of many tents may deter the user from setting up the tent correctly, due to the number of connected parts and their differing orientations. This can be detrimental to the safety and comfort of the user as tents provide a variety of safety barriers for the user including a physical barrier from insects or animals, insulation, and dry storage. Furthermore, many tents are shaped and designed for cosmetic appeal or to shed environment elements contacting the tent. Current tents typically embody a concave roof or slanted roof to shed these environmental elements. Environmental elements undesired to enter the sleeping area in some situations may be rain, snow, wind, insects, animals, organic matter, plants, soil, and much more.

The design factors listed above in current tent designs cause the user to spend an unnecessary amount of time assembling tents, as current common tent designs are oriented towards the cosmetic and marketable consumer aspects of the product and not towards the necessities of the user. Furthermore, many tents or portable sleeping structures lack compartmentalized sections within the tent or structure, allowing for more than the body of the user to fit inside. For example, most backpacking or lightweight tents are one large compartment, not multiple compartments for the user and the remainder of their portable gear such as backpacks, clothes, cooking equipment, lights, shoes and much more. The downside to this is while the user has a comfortable place to sleep, separated from the environmental elements, the remainder of their portable gear is subject to the elements due to a lack of storage space. Secondly, if the user decides to bring the remainder of their portable gear into the sleeping portion of the tent or portable sleeping structures the user then has to sleep with their gear on top or below their body due to the confined space. Thirdly, many current tents require extra securing means such as rope, bungees or straps to secure the tent inside a storage bag or onto another article of portable gear such as a backpack or raft. The process of securing the tent inside a storage bag or onto another article of portable gear needs to be secured tightly during transportation by the user. Often this securing process takes the user additional unnecessary time before being to travel to their next destination.

BRIEF SUMMARY OF THE INVENTION

Regarding these shortcomings, the rectangular portable tent of the present invention sets out to provide the user the simplest and most reliable assembly process, saving the user time and providing a comfortable shelter shielding them from environmental elements. Furthermore, in some embodiments, the rectangular portable tent of the present invention provides the user compartmentalized storage of other portable gear within the same tent structure, giving the user dry storage for everything, not just their body. Finally, the user is not confined to the fixed volume of traditional tent structure, as multiple rectangular portable tents of the present invention may be easily joined to expand or reduce the internal volume of the tent as needed.

The rectangular portable tent of the present invention includes multiple components including: a main shell, an opening on the main shell, an accessory component, a divider component within the main shell, a support assembly, and a structural tie. In one embodiment, he rectangular portable tent is normally sealed forming a contained internal volume and the user can open various accessory components or access openings to allow airflow in or out of the internal volume of the tent. In one embodiment, the main shell is the foremost layer of protection for the user and the internal volume of the tent from environment elements. In one embodiment, the main shell may encompass multiple shells or layered material. In one embodiment, the opening allows for access of the user into and out of the tent when desired by the user or placement of other portable gear into or out of the tent when desired. In another embodiment, the opening in some embodiments may comprise a plurality of opening positioned on any side or face of the rectangular portable tent. In one embodiment, the opening may be positioned on the seams of the rectangular tent. In one embodiment, the accessory component can be mounted on any external or internal side of the main shell or shells of the rectangular portable tent. In some embodiments, the rectangular portable tent can comprise of multiple accessory components. In one embodiment, the divider component is configured to divide the internal volume of the rectangular portable tent into multiple internal storage volumes. In one embodiment, the divider component is affixed to the main shell or shells of the rectangular portable tent. In alternative embodiments, the divider component can be adjustable or removable by the user. In some embodiments, the rectangular portable tent can comprise of a plurality of divider components. In one embodiment, a support assembly gives support to the main shell forming the internal volume. Advantageously, the support structure is optimally placed throughout the rectangular portable tent to minimize weight and assembly time. In one embodiment, the structural tie secures the external side of the rectangular portable tent to a rigid structure in close proximity to the main shell. These rigid structures can be, but are not limited to, the ground, trees, vehicles, rocks, or a building.

It is an object of the present invention, to provide a rectangular portable tent enabling the user easy, assisted, and custom storage as well as shelter from unwanted environmental elements. Advantageously, the rectangular portable tent is easily folded, packed, or rolled for storage during transportation by the user. In one embodiment, the rectangular portable tent may be adjoined to or a member of another piece of portable gear, such as a backpack. Additionally, the internal volume size of the rectangular portable tent is expandable or reducible by the connection of multiple rectangular portable tents to each other. Adjustment, removal, or the addition of multiple divider components, openings, accessory components give the user the tent they desire for their specific needs.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide a rectangular portable tent.

Unless otherwise defined, all technical terms used herein have the same meaning as commonly understood by one of ordinary skill in the art to which this disclosure belongs. As used herein, the singular forms "a," "an," and," and "the" include plural references unless the context clearly dictates otherwise. Any reference to "or" herein is intended to encompass "and/or" unless otherwise stated. As used herein, the term "about" refers to an amount that is near the stated amount by about 0%, 5%, or 10%, including increments therein. Unless otherwise defined, all technical terms used herein have the same meaning as commonly understood by one of ordinary skill in the art to which this disclosure belongs.

Figure 1A:
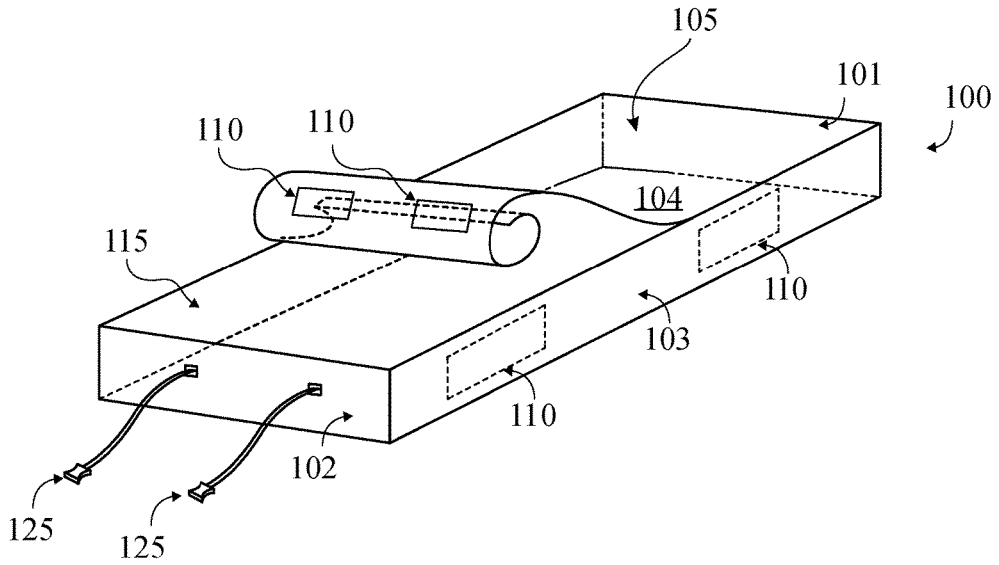
FIG. 1A shows an exemplary isometric right view of a rectangular portable tent according to an embodiment of the present invention.
Figure 1B:
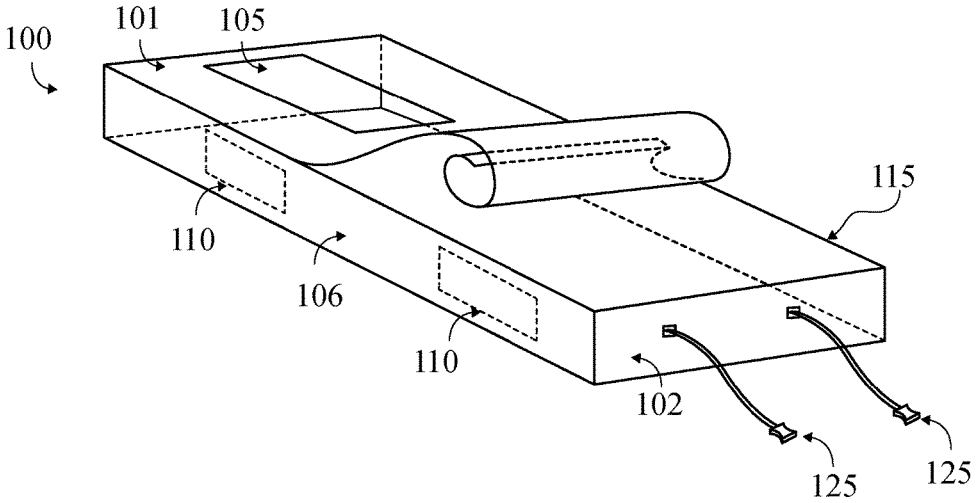
FIG. 1B shows an exemplary isometric left view the rectangular portable tent according to an embodiment of the present invention.

FIGS. 1A-B illustrate a rectangular portable tent 100 in exemplary form from an isometric view. Referring now to FIGS. 1A-B, the rectangular portable tent comprises a main shell 115 configured to shield the user from environmental elements including, but not limited to, rain, snow, hail, wind, organic matter, insects, and animals. In one embodiment, the main shell forms a rectangle of six faces including a top face 101, a rear face 102, a right face 103, a bottom face 104, a left face 106, and a front face 107. Each of the six faces having a respective external side and an internal side. In the current exemplary embodiment, the right face, the left face, the front face, and the rear face are of the same height. In some embodiments, the main shell is made of least one member of a material set consisting of: a nylon material, a cotton canvas material, a PVC coated material, a polycotton material, a reflective layer, an insulated layer, a polyester material, a vinyl material, a vinyl composite material, a waxed canvass material, a plastic material, a polyurethane material, and a mesh material. In some embodiments, each individual face may include a panel of a different material than the other faces. The material is selected depending on the intended use, environment, and temperature the rectangular tent is subjected to, as well known in the art. In one embodiment, an accessory component 110 or plurality of accessory components 110 may be located on any internal or external side of the six faces of the rectangular main shell. In some embodiments, the accessory component may comprise at least one member of an accessory set consisting of: a pouch, a pocket, a sleeve, a water bladder, an inflatable bladder, an elastic band, and a hook. Advantageously, the inflatable bladder can be used as a life raft or jacket. It is understood that the at least one accessory component may vary in size and location. For instance, in some embodiments, inflatable bladders can be utilized as a bed if positioned on the internal surface of the bottom face. In one embodiment, inflatable bladders may be positioned to add rigidity to the rectangular tent. In alternative embodiments, an accessory component of the at least accessory component may be removed leaving a vent, which may be a mesh vent.

Still referring to FIG. 1, in one embodiment, structural ties 125 are provided. The structural ties comprise a strap and clip method of joining the main shell of the rectangular portable tent to a nearby rigid structure. In some embodiments, the nearby rigid structure is at least one member of a rigid set consisting of: the ground, a plant, a rock, a vehicle, a wood article, and a metal article. Advantageously, this allows the user a secure point of attachment to apply tension or pressure to the structural ties and consequently the main shell. In some embodiments, the structural tie or ties is at least one member of a structural set consisting of: a stake, a ratchet, a clip, a rope, a bungee, an elastic material, a chain, and a wire. Different environments such as soil, rock, or gravel will determine if the user will use a certain member of the structural set. In a preferred embodiment, the structural tie or ties are stakes driven into soil by the user (best seen in FIG. 1B).

An opening 105 in the top face of the main shell allows the user to go inside the rectangular portable tent. In some embodiments, an accessory component 110 may be attached to the main shell 115 by at least one member of an attachment set consisting of: a zipper, a Velcro® strip (hook-and loop fasteners), a strap, a clip, a button, a rope, a magnet, a hook, a bungee, a welded seam, a sewn seam, a staple, and an adhesive. Likewise, the opening may be accessed via an attachment set selected from any attached method previously mentioned. Although, the opening is pictured on the front face adjacent to the top face of the main shell, it is understood that the opening may be positioned at any location. In some embodiments, an accessory component may be on the external side or internal side of any of the six faces of the main shell, including but not limited to the top face, the rear face, the right face, the bottom face, the left face, and the front face. In one embodiment, the opening is positioned on the seams and is accessed by another attachment set as previously described. In one embodiment, the seams are waterproof or water resistant. In other embodiments, the seams and the openings may be accessed by quick release methods. In yet other embodiments, the opening may be positioned in a central location away from the seams of the rectangular tent, best seen in FIG. 1A.

Figure 2A:
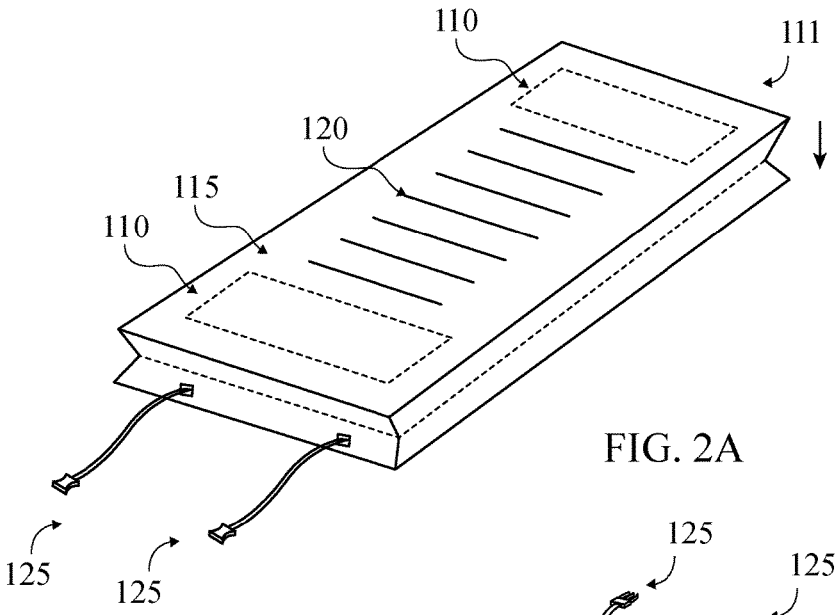
FIGS. 2A-D show exemplary isometric views of the packing motion of the rectangular portable tent according to an embodiment of the present invention.

FIGS. 2A-D shows exemplary isometric views of the packing motion of the rectangular portable tent according to an embodiment of the present invention. Referring now to FIG. 2A, a first step 111 of an exemplary collapsing motion or packing motion of the rectangular portable tent is provided. In the current exemplary embodiment, as previously described top face 101 of the rectangular portable tent 100 has multiple accessory components 110. Further in some embodiments, a graphic or instructions 120 directing the user may be provided. In some embodiments, the graphic instructs the user by displaying at least one member of a graphic set consisting of: a first aid procedure, an assembly procedure, a brand, an alphanumeric identification, a user's name or identification, a symbolic shape, a company brand, a numeric identification number, a QR code, a barcode, and an RFID tag.

Figure 2B:
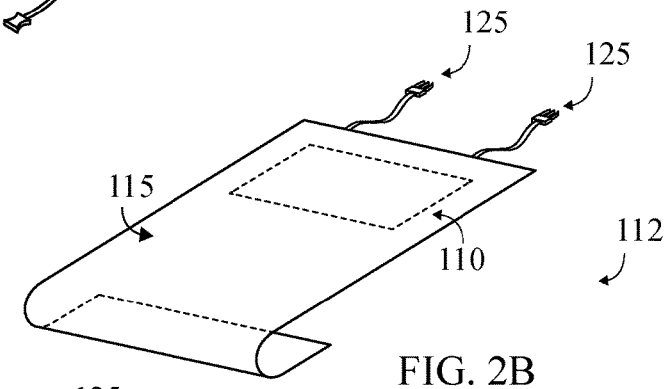
Figure 2C:
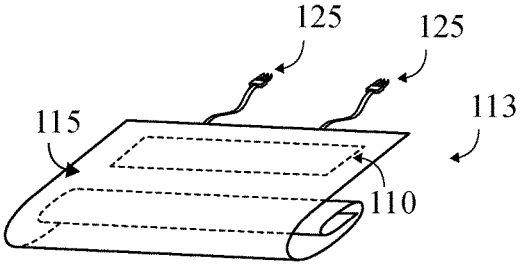
Figure 2D:
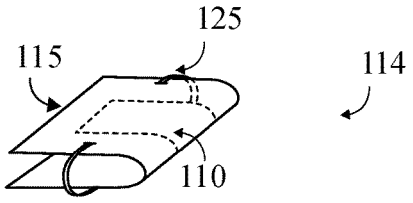
Figure 3:
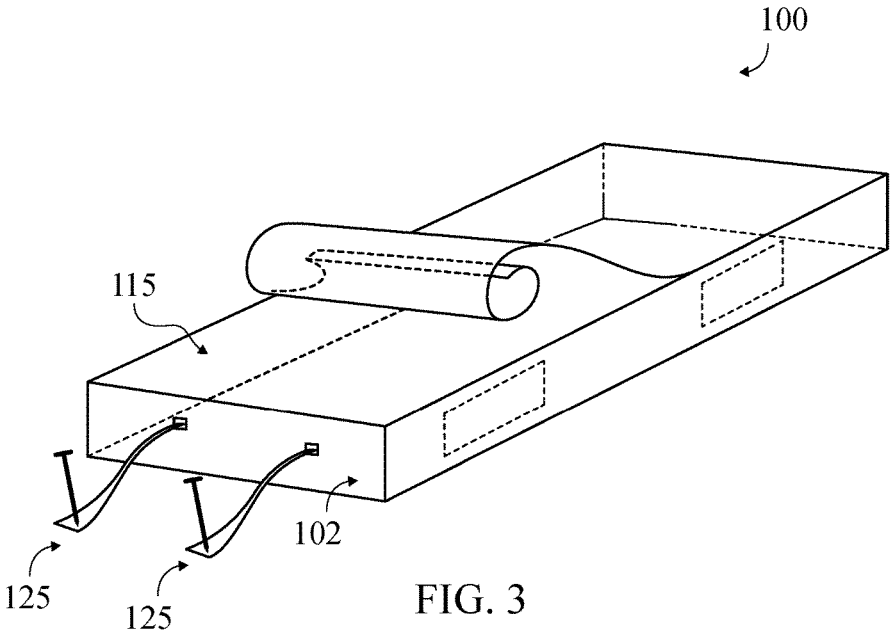
FIG. 3 shows an exemplary isometric view of the rectangular portable tent with an alternative structural tie according to an embodiment of the present invention.

Referring to FIG. 2B, a second step 112 of the packing motion is illustrated. As shown, main shell 11 is flattened. Additionally, the bottom face of the main shell is shown opposite the top face. Exemplary structural ties 125 of the current embodiment are shown extending from the front face of the main shell 115. Referring to FIG. 2C, a third step 113 of the packing motion is illustrated. In this step, the a flattened main shell is rolled as illustrated to reduce the occupied space of the tent. Referring to FIG. 2D, a forth step 114 of the packing motion is illustrated. The fourth step includes folding the rolled flattened main shell over in a transverse motion, advantageously saving the maximum possible space and limiting the occupied space of the tent. Now, the tent is ideal for storage or travel.

Figure 4:
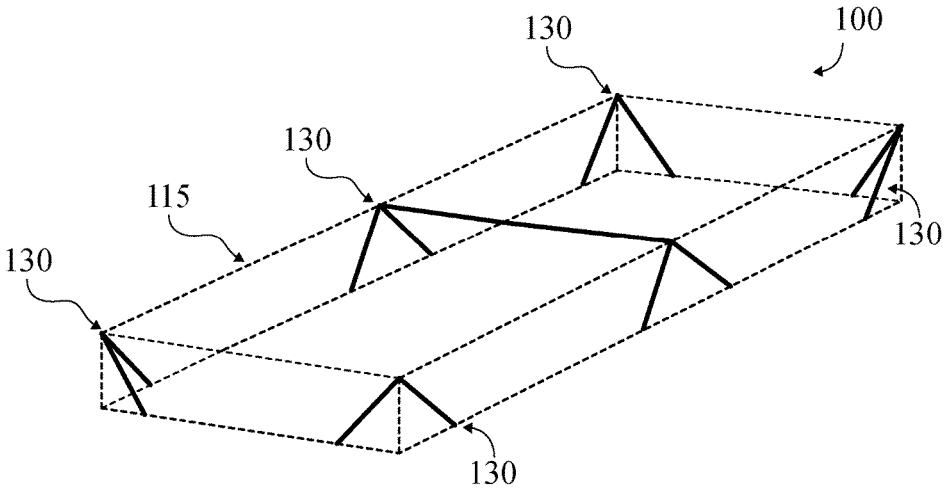
FIG. 4 shows an exemplary isometric view of the support assembly of the rectangular portable tent according to an embodiment of the present invention.

FIG. 4 shows an exemplary configuration of a support assembly 130 and the outline of a hidden main shell 115. In some embodiment, main shell 115 of rectangular portable tent 100 may be supported by a support assembly 130 that touches at least two faces of the six main shell faces as illustrated. The current exemplary embodiment is designed to have two support assemblies on each of the four corners of the six faces of the main shell. These support assemblies in the current embodiment brace against each other to offset horizontal forces and provide a structure of framing to hold the top face and the bottom face of the main shell apart forming an internal volume. In some embodiments, additional support assemblies 130 may be placed at and span along the distance between the front face and rear face or the right face and left face. In some embodiments, the support assemblies are made of at least one member of a support material set consisting of: a metal material, a carbon fiber material, a plastic material, a wood material, and a fiberglass material. The shape of the support assemblies may include any of the following shapes essentially consisting: a hollow rod, a solid rod, a solid tube, a hollow tube, and a triangular shaped fitting. These materials provide rigidity to the tent and can reduce weight carried by the user. More specifically, based on the specific weight of materials used and optimal design of the support assemblies configured to use the minimum amount of material as possible.

Figure 5:
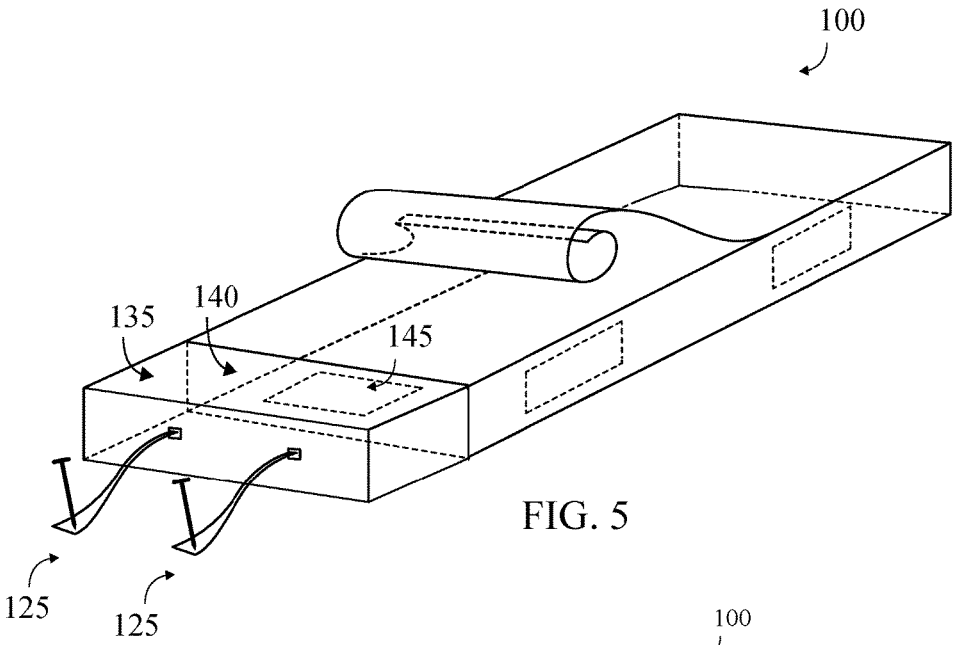
FIG. 5 shows an exemplary isometric view of separate compartments within the rectangular portable tent according to an embodiment of the present invention.

FIG. 5 illustrates a divider component 140 of the rectangular portable tent attached to the main shell to form additional separated portions 135 of storage space for the user, or be used for tasks other than sleeping. It should be understood, that the divider component is not limited to attachment at the rear face of the main shell as illustrated, but in other embodiments may be attached to the external side or internal side of any of the six faces of the main shell. In some embodiments, the divider component may be attached to the main shell 115 by at least one member of an attachment set consisting of: a zipper, a Velcro® strip, a strap, a clip, a button, a rope, a magnet, a hook, a bungee, a welded seam, a sewn seam, a staple, and an adhesive. In some embodiments, the divider component, forms the internal volume of the main shell into separated portions 135. These separated portions allow for separation of where the user sleeps and where other portable gear such as backpacks, cooking gear, food, ice, water, or, clothes is stored. It should be understood, that the amount of divider components is not limited to one, thus multiple separated portions may be provided. However, in the preferred embodiment, a continuously internal volume is desired, or alternatively one separated portion. Although the advantageous of the separated portions remains apparent, the extra length of the tent required adds to the overall occupied space and weight of the tent which may not be ideal depending on desired use.

Figure 6:
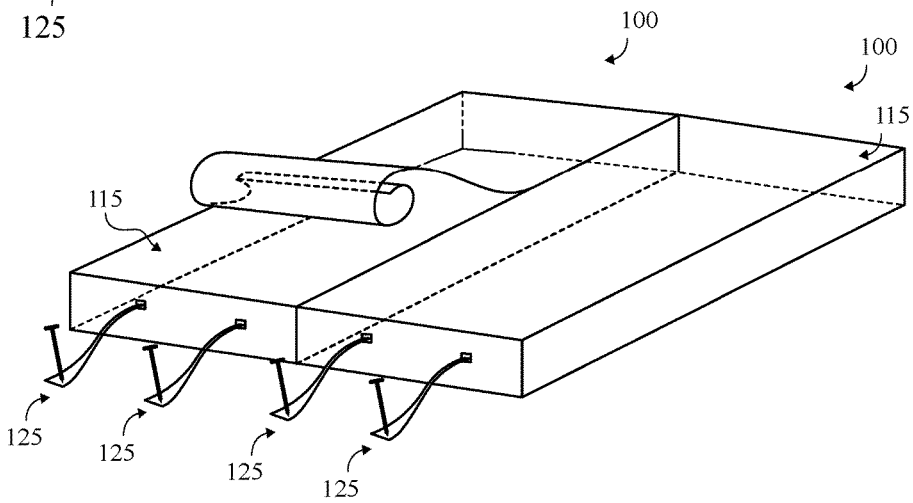
FIG. 6 shows an exemplary isometric view of multiple joined rectangular portable tents according to an embodiment of the present invention.

Similarly, FIG. 6 shows a similar embodiment, in which an exemplary configuration of at least one external side or internal side of the six faces of a main shell of at least two rectangular portable tents are adjoined by at least one member of an attachment set consisting of: a zipper, a Velcro® strip, a button, a strap, a rope, a clip, a magnet, a hook, a bungee, a welded seam, a sewn seam, a staple and an adhesive.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention. For instance, various colors may be used for the rectangular tent based on the intended use of the rectangular tent.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A rectangular portable tent comprising:

a rectangular main shell having an external side and an internal side forming an internal volume, the rectangular main shell having six faces consisting of a top face, a bottom face, a left face, a right face, a front face, and a rear face, wherein the right face, the left face, the front face, the rear face are of the same height;

an opening located on the rectangular main shell, wherein the opening allows for access to the internal side of the rectangular main shell;

at least one accessory component joined to the rectangular main shell via an attachment set;

a support assembly arranged to support the rectangular main shell;

a structural tie attached to the rectangular main shell, wherein the structural tie is configured to secure the rectangular main shell to a nearby rigid structure; and, wherein the at least one accessory component is a water bladder configured to hold drinking water.

2. The rectangular portable tent of claim 1, wherein the rectangular main shell is constructed from a material consisting of: a nylon material, cotton canvas material, a PVC coated material, a polycotton material, a reflective layer, an insulated layer, a polyester material, a vinyl material, a vinyl composite material, a waxed canvass material, a plastic material, a polyurethane material, and a mesh material.

3. The rectangular portable tent of claim 1, wherein the rectangular portable tent is configured to combined with at least one other rectangular portable tent.

4. The rectangular portable tent of claim 1, wherein the at least one accessory component is a pouch, a pocket, or a sleeve.

5. The rectangular portable tent of claim 4, wherein the at least one accessory component is located on the external side and/or the internal side of the six main shell faces.

6. The rectangular portable tent of claim 4, wherein the accessory component is joined to the main shell by at least one member of an attachment set consisting of: a zipper, a hook-and loop fasteners, a strap, a clip, a button, a rope, a magnet, a hook, a bungee, a welded seam, a sewn seam, a staple, and an adhesive.

7. The rectangular portable tent of claim 1, wherein the at least one accessory component is an inflatable bladder.

8. The rectangular portable tent of claim 7, wherein the inflatable bladder is configured to be used as a life jacket or life raft.

9. The rectangular portable tent of claim 7, wherein the inflatable bladder is configured to be used as a bed.

10. The rectangular portable tent of claim 1, wherein the opening is joined to the rectangular main shell by a zipper or a hook-and loop fastener.

11. The rectangular portable tent of claim 1, further comprising at least one divider component completely dividing the internal volume into different sealable portions.

12. The rectangular portable tent of claim 1, wherein the support assembly is made of at least one member of a support material set consisting of: a metal material, a carbon fiber material, a plastic material, a wood material, and a fiberglass material.

13. The rectangular portable tent of claim 12, wherein the support assembly touches at least two faces of the six main shell faces.

14. The rectangular portable tent of claim 12, wherein the support assembly comprises at least one member of a support structure set consisting of: a hollow rod, a solid rod, a solid tube, and a hollow tube.

15. The rectangular portable tent of claim 1, wherein the structural tie is at least one member of a structural set consisting of: a stake, a ratchet, a clip, a rope, a bungee, an elastic material, a chain, and a wire.

16. The rectangular portable tent of claim 15, wherein the portable tent comprises a plurality of structural ties.

17. The rectangular portable tent of claim 1, wherein the portable tent is configured to collapsed and folded to occupy minimal space for storage or travel.

18. The rectangular portable tent of claim 17, wherein the portable tent is configured to be adjoined to a backpack.

19. The rectangular portable tent of claim 1, wherein the nearby rigid structure is at least one member of a rigid set consisting of: the ground, a plant, a rock, a vehicle, a wood article, and a metal article.

20. A rectangular portable tent comprising:

a rectangular main shell having an external side and an internal side forming an internal volume, the rectangular main shell having six faces consisting of a top face, a bottom face, a left face, a right face, a front face, and a rear face, wherein the right face, the left face, the front face, the rear face are of the same height;

an opening located on the rectangular main shell, wherein the opening allows for access to the internal side of the rectangular main shell;

at least one accessory component joined to the rectangular main shell via an attachment set;

a support assembly arranged to support the rectangular main shell;

a structural tie attached to the rectangular main shell, wherein the structural tie is configured to secure the rectangular main shell to a nearby rigid structure; and, a divider component separating the internal volume into a first waterproof portion and a second waterproof portion, wherein the first and/or second waterproof portion is configured to retain drinking water.

* * * * *